United States Patent [19]

Smejda

[11] 4,133,293

[45] Jan. 9, 1979

[54] LIQUID FEEDING, PATTERNING AND BLENDING SYSTEM

[76] Inventor: Richard K. Smejda, 192 Edmund Ave., Paterson, N.J. 07502

[21] Appl. No.: 835,904

[22] Filed: Sep. 23, 1977

Related U.S. Application Data

[63] Continuation-in-part of Ser. No. 637,167, Dec. 3, 1975, abandoned, which is a continuation-in-part of Ser. No. 430,586, Jan. 3, 1974, abandoned.

[51] Int. Cl.[2] ..... B05C 3/18

[52] U.S. Cl. ..... 118/411; 68/200; 101/211; 118/413

[58] Field of Search ..... 118/411, 412, 413; 101/211, 365; 68/200

[56] References Cited

U.S. PATENT DOCUMENTS

| | | | |
|---|---|---|---|
| 896,504 | 8/1908 | Adams | 118/412 |
| 1,112,960 | 10/1914 | Adams et al. | 118/412 |
| 2,891,474 | 6/1959 | Smejda | 101/365 |
| 2,916,012 | 12/1959 | Hergenrother | 118/412 X |
| 3,014,454 | 12/1961 | Smejda | 118/413 X |

*Primary Examiner*—John McIntosh

*Attorney, Agent, or Firm*—Edward R. Weingram

[57] ABSTRACT

A liquid feeding system includes a plurality of adjacent liquid feeding chambers having outlets disposed in a laterally aligned integral assembly to supply liquid to a substrate material passing across the outlets. The liquid feeding chambers are divided by vertical partitions into independent units of substantially uniform width and height. A plurality of liquid control means detachably engage the partitions and extend from the chamber outlets to contact the substrate and provide longitudinal passages having selective restricted openings and solidly enclosed sealed boundaries. The liquid control means may be in the form of like sized apertured inserts fitting into the outlets between the partitions and permitting liquid flow only through the selectively dimensioned apertures. Adjacent inserts may include laterally communicating channels between longitudinal passages and overlapping apertures to provide openings of larger widths and varying patterns. Deflecting elements in the passages improve mixing and blending of liquids. Scraper blades seal the lower edge of the liquid control means and provide additional modifications of the liquid applied to the substrate. Various stripes, blends and combinations of colors are obtainable.

10 Claims, 5 Drawing Figures

LIQUID FEEDING, PATTERNING AND BLENDING SYSTEM

This application is a continuation-in-part of application Ser. No. 637,167, filed Dec. 3, 1975 which is in turn a continuation-in-part of application Ser. No. 430,586, filed Jan. 3, 1974, both of which are now abandoned.

BACKGROUND OF THE INVENTION

1. Field of the Invention

The present invention relates to systems for applying liquids to substrate materials and particularly to a device having selective restricted openings which can combine the liquids in a plurality of patterns, colors and designs.

2. Description of the Prior Art

Presently available devices for applying liquids in the form of stripes, colors and patterns to materials such as fabrics are somewhat complex and have limited capabilities. Examples of such devices are found in U.S. Pat. No. 2,891,474 issued June 23, 1959; and U.S. Pat. No. 3,014,454 issued Dec. 26, 1961, both to the present inventor. The former patent has a plurality of partitions dividing the liquid feeding area into a series of constant sized openings. A vertical gate between the feeder chambers and the openings provides a flow control. Permeable partitions provide some mixing between adjacent openings and a brush-like contact provides the upper boundary. The latter patent permits some variation in the width of the openings by extensions which fit onto the partitions and are curved to the right or left. The height, however, remains constant and is bounded by a permeable brush. The types of patterns and controls available are thus quite limited.

SUMMARY OF THE PRESENT INVENTION

It is therefore the primary object of the present invention to provide a liquid feeding device which applies liquids to materials in various selective stripes, patterns and blends through specifically defined and controlled apertures.

It is another object to provide a plurality of detachable interchangeable liquid control means which are selectively and easily insertable into the feeding chambers to combine various sized and shaped openings to achieve the particular desired patterns.

A further object is to combine and link apertures of adjacent liquid controlling inserts to provide patterns of extended widths and various blends.

These objects are accomplished with a liquid feeding system having a plurality of detachable liquid control inserts fitting into a plurality of like sized partitioned liquid feeding chambers. The chambers and inserts form an integral assembly aligned laterally across the path of a longitudinally directed substrate. The inserts include longitudinal passages having specifically defined openings of selective shapes and sizes, with solidly enclosed sealed boundaries to limit liquid flow to the particular openings. Adjacent inserts may have laterally connecting channels joining the longitudinal passages and more than one opening to provide patterns of extended width and various designs and blends. Deflection elements in the longitudinal passages provide mixing and blending of the liquids. Scraper blades seal the lower edge of the inserts and may add further pattern variations. Other objects and advantages will become apparent from the following description in conjunction with the accompanying drawings.

DESCRIPTION OF THE PREFERRED EMBODIMENTS

The liquid feeding system of the present invention is concerned with the direct application of liquids to various substrates such as sheets, webs and rolls of textile materials. The necessary apparatus for supplying the liquids to the feeding chambers behind the outlet assembly is the subject of another copending application of the present inventor, now issued as U.S. Pat. No. 3,995,581, dated Dec. 7, 1976. The number of feeder chambers may range from ninety to two hundred across a particular application plane. This permits an almost unlimited variety of stripes, patterns and blends to be obtained with various interchangeable inserts positioned in the outlets of each uniformly dimensioned chamber. The size and shape of the apertures of the patterning inserts is selected in accordance with many variables such as viscosity, boundary interference and flow pressure of the liquids, as well as the desired color combinations and pattern designs.

Figure 1:
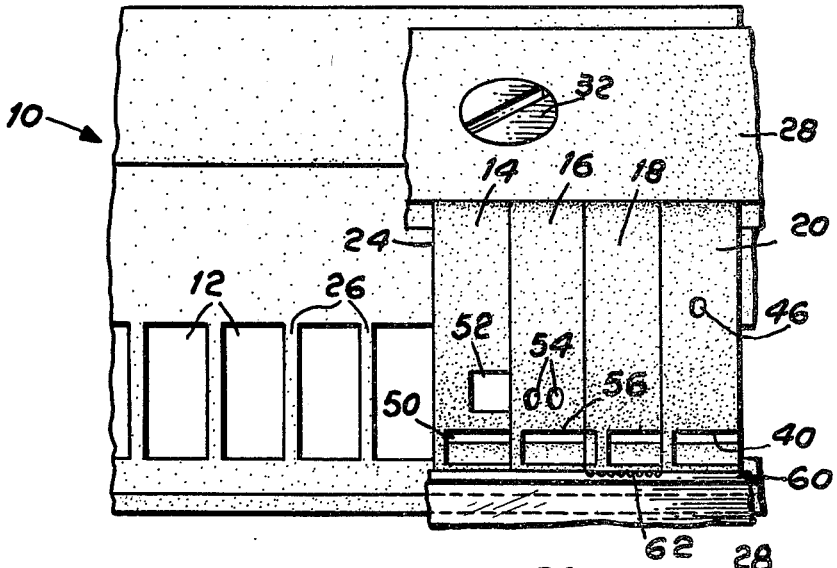
FIG. 1 is a partial front view of the liquid feeding system showing several apertured liquid control inserts and several feeder chamber outlets with the inserts removed.
Figure 4:
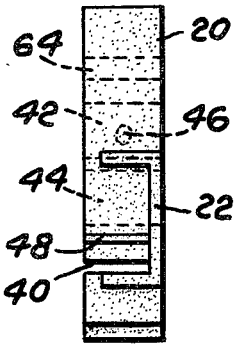
FIG. 4 is a back view of the insert of FIG. 3.
Figure 2:
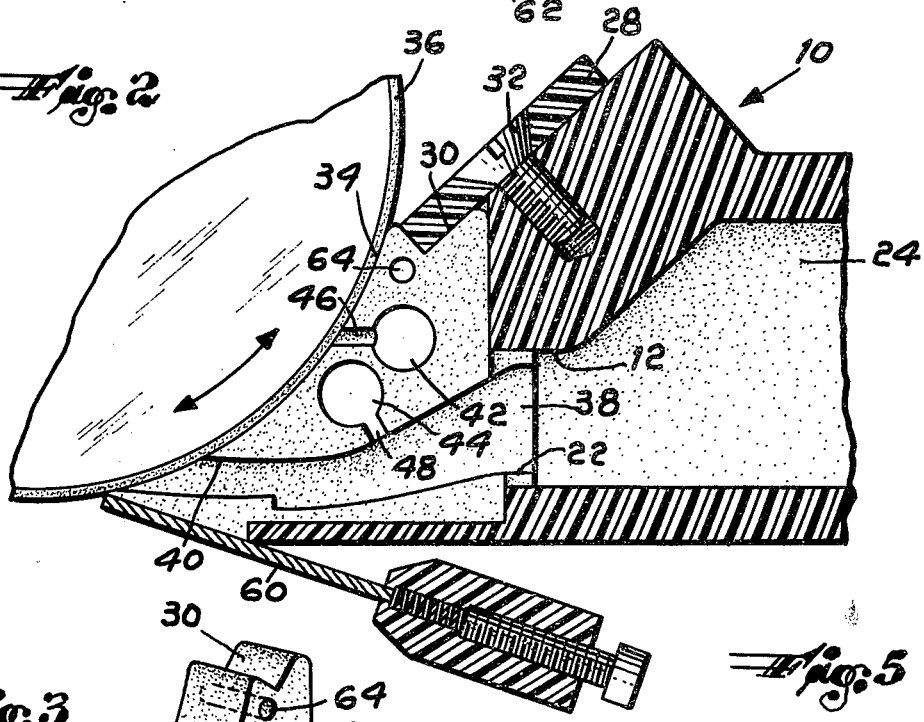
FIG. 2 is a side view showing a partial cross-section of a liquid feeder chamber outlet and apertured liquid control insert applying liquid to a substrate material.

As shown in FIGS. 1 and 2, a liquid feeder block 10 includes a plurality of feeder chambers having like sized rectangular outlets 12, each of which may be supplied with a separate liquid of a different color. A corresponding number of separate interchangeable detachable liquid control inserts, only four of which are shown, 14, 16, 18, 20, are disposed over the outlets in liquid-tight sealing engagement. Each insert has a flanged back 22, around three sides of a rear opening, as shown in FIGS. 2 and 4, which fits closely within a corresponding longitudinal outlet 12. A vertical wall 24 on one side of each insert fits tightly against the adjacent side of the next insert. The vertical partitions 26 between feeder outlets 12 engage the back of each insert along the open side of each flange 22 opposite wall 24 to enclose the rear opening. A retaining bar 28 engages a lateral groove 30 along the upper edge of each like sized and shaped insert and screws 32 fasten the plurality of inserts to the feeder block 10 in a laterally aligned sealed position over the outlets 12.

Figure 3:
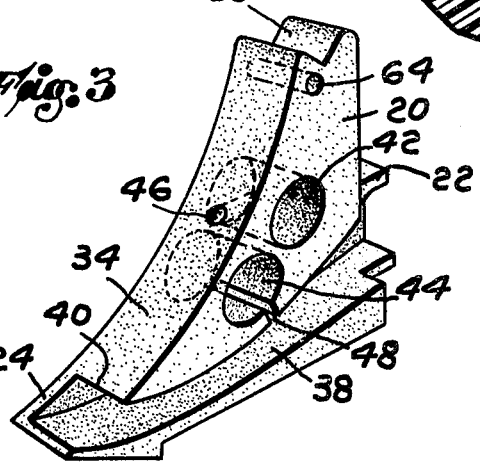
FIG. 3 is a pictorial view of a typical apertured insert of FIGS. 1 and 2.

The forward face 34 of each insert 12 is preferably curved and angled to form a liquid application surface contacting a moving substrate material 36 which can be fed at any angle and either direction longitudinally across the aligned inserts. Each insert includes a longitudinal curved passage 38 open at one side between the larger rear opening at outlet 12 to a smaller aperture 40 at the front face. Apertures 40 in each insert may be of varying width, height or shape to selectively apply liquid stripes of various widths, penetration and blends. As shown in FIGS. 2 and 3, a plurality of laterally communicating passageways or cross-channels 42, 44 are formed in selective inserts to direct liquids from particular outlets crosswise through adjacent inserts to provide various striped patterns of different colored liquids. Thus, channel 42, having openings through both sides of insert 20, may direct liquid of one color between insert 18 and another adjacent insert on the opposite side (not shown) and apply a stripe of that color through a small second aperture 46 on the front face of insert 20. The color of the liquid from aperture 46 will then overlap and blend with the larger stripe of liquid of another color from aperture 40 as the substrate moves along the front face to provide a thin stripe of a mixed color within the larger stripe of the other color. If the substrate is fed upwardly instead of downwardly, the smaller apertures may be positioned at the forward edge of the inserts below the larger openings. Channel 44, also open at both sides of insert 20, has a small internal lateral slot 48, which joins longitudinal passage 38 to direct liquid from the feeder outlet 12 behind insert 20 to the two adjacent inserts. If desired, the vertical wall 24 of insert 20 may not have openings for either channel 42 or 44 so that liquid would be directed only to and from an adjacent insert on the other side having corresponding channels. The channels may be closed or open at any location to provide any desired pattern or mixture. The vertical wall 24 of each insert is generally closed but may also be opened at any location to connect to a cross channel of an adjacent insert. Various other combinations of apertures on the front face and cross channels between inserts, having internal or external openings, may be employed. Thus, insert 14 has two overlapping rectangular apertures 50, 52, of different sizes, while insert 16 has two small, round apertures 54 above a larger rectangular aperture 56 which is continued laterally across the wall of insert 18 by an adjacent matching aperture. Apertures 54 may be connected through lateral channels between inserts 14 and 18.

Figure 5:
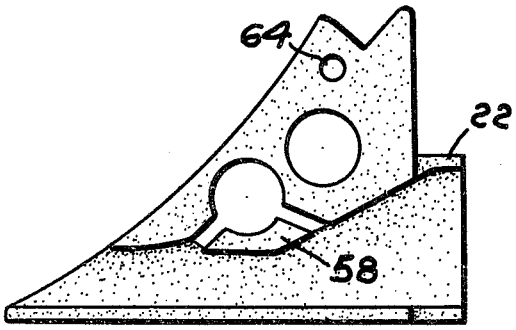
FIG. 5 is a side view showing another liquid control insert configuration.

FIG. 5 shows another variation of an apertured insert having a straight base and a deflecting element or projection 58 extending laterally across the longitudinally passageway. This projection serves to promote more uniform mixing and blending of liquid. Pressure on the liquids tends to build up at the edges of the aperture in contact with the substrate and impede the direct flow. The lateral projection, however, causes the liquid to circulate more freely to counteract the back pressure.

FIGS. 1 and 2 also show a spring biased adjustable scraper or doctor blade 60 which may be used, if desired, to scrape off excess liquid. This excess liquid causes additional pressure at the edges of the front aperture which may likewise be reduced by the lateral projection that recirculates the liquid. The blade also serves as a seal along the lower edge and promotes penetration of the liquid into the porous substrate materials. The end of the scraper blade may also have convolutions 62, such as shown at the lower edge of insert 18, which provide further liquid stripe pattern variations. Another lateral hole 64 extends through all of the inserts. This hole is adapted to receive a long thin rod or thick wire which is used to hold selective groups of inserts together for mounting over the feeder outlets.

As mentioned above, the width, shape and height of the apertures control the flow, contact time and penetration of the liquid into the passing substrate. A higher opening thus exposes the substrate for a longer time, a wider opening provides a wider stripe, and overlapping openings provide mixtures, with the opening that contacts the substrate first having the greater control. The width and height of all the feeder chamber outlets 12 are uniform to permit standardization of the liquid feeding and interchangeability of the apertured inserts. The substrate carrier may be a plain roller having a metal, plastic or rubber surface, or may be an embossed roller. The carrier may also be curved or flat depending upon the type of processing and substrate employed. The liquid may also be applied to intermediate engraved or patterned carriers for transfer to substrate.

The use of separate interlocking sealed inserts provides a completely enclosed system which isolates fluids in each feeder chamber except for the mixtures and combinations provided by the selected apertures in the inserts. Openings of various numbers, sizes and shapes can be provided at any desired location in the inserts independent of the standard size of the feeder chamber outlets to permit an unlimited choice of application patterns.

While several embodiments have been illustrated and described, it is apparent that many other variations may be made in the particular design and configuration without departing from the scope of the invention, as set forth in the appended claims.

What is claimed is:

1. A liquid feeding system comprising:

a plurality of longitudinally extending liquid feeding chambers having like-sized outlets disposed successively in a laterally aligned integral assembly and adapted to supply liquid to an adjacent carrier passing across the outlets, and a plurality of detachable liquid control means mounted in sealing engagement with respective said outlets and extending forwardly from and laterally across said outlets for contacting and applying liquid from said outlets to said carrier, said control means having a front face and including longitudinal passages communicating with said outlets and having selectively shaped solidly bounded openings on said front face of different dimensions than that of said outlets, and cross channels extending laterally through said control means for laterally communicating liquid between selective longitudinal passages of adjacent control means.

2. The device of claim 1 wherein said detachable control means includes a plurality of like sized interchangeable apertured inserts, each insert extending into, across and forwardly from a respective outlet and fitting closely against adjacent inserts to direct liquid from said outlets through said longitudinal passages and openings.

3. The device of claim 2 including means for securing said inserts in sealing engagement with said feeding chamber outlets.

4. The device of claim 3 wherein said inserts include a plurality of openings of different height, width and shape.

5. The device of claim 3 wherein said cross channels laterally communicate between a plurality of inserts.

6. The device of claim 3 wherein adjacent inserts include matching adjoining openings having a combined width extending across a plurality of inserts.

7. The device of claim 3 wherein one insert includes a plurality of vertically spaced overlapping openings and a cross channel communicating with one of said openings.

8. The device of claim 3 including blending means positioned within said passages.

9. The device of claim 3 wherein said inserts have a forward edge and including scraper means disposed at said forward edge of said inserts.

10. The device of claim 3 including means for linking a plurality of inserts in a common group.

* * * * *